US009283775B2

(12) United States Patent
Nomura

(10) Patent No.: US 9,283,775 B2
(45) Date of Patent: Mar. 15, 2016

(54) IMAGE RECORDING DEVICE INCLUDING LIGHT SOURCES

(71) Applicant: SEIKO EPSON CORPORATION, Tokyo (JP)

(72) Inventor: Yujiro Nomura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/633,626

(22) Filed: Feb. 27, 2015

(65) Prior Publication Data

US 2015/0165788 A1 Jun. 18, 2015

Related U.S. Application Data

(63) Continuation of application No. 13/862,704, filed on Apr. 15, 2013, now Pat. No. 8,998,401.

(30) Foreign Application Priority Data

Apr. 24, 2012 (JP) ..... 2012-098777

(51) Int. Cl.

| | |
|---|---|
| ***B41J 2/01*** | (2006.01) |
| ***B41J 11/00*** | (2006.01) |
| ***B41J 2/21*** | (2006.01) |

(52) U.S. Cl.

CPC ..... *B41J 11/002* (2013.01); *B41J 2/2114* (2013.01); *B41J 11/0015* (2013.01)

(58) Field of Classification Search

None

See application file for complete search history.

(56) References Cited

U.S. PATENT DOCUMENTS

| | | | | |
|---|---|---|---|---|
| 2008/0311299 | A1 | 12/2008 | Furukawa | |
| 2009/0189940 | A1 | 7/2009 | Matsuhashi | |
| 2010/0194838 | A1 * | 8/2010 | Mitsuzawa | 347/102 |
| 2011/0069113 | A1 * | 3/2011 | Shimizu et al. | 347/22 |
| 2012/0147095 | A1 * | 6/2012 | Miura et al. | 347/47 |

FOREIGN PATENT DOCUMENTS

| | | | |
|---|---|---|---|
| JP | 2008-105382 | A | 5/2008 |
| JP | 2009-196352 | A | 9/2009 |
| JP | 2011-067964 | A | 4/2011 |
| JP | 2012-040837 | A | 3/2012 |

* cited by examiner

*Primary Examiner* — Bradley Thies

(74) *Attorney, Agent, or Firm* — Global IP Counselors, LLP

(57) ABSTRACT

An image recording device is provided with a plurality of color ink heads, first irradiation units which are disposed between the color ink heads which are adjacent, a second irradiation unit which is disposed more to the downstream side in the transport direction than the plurality of color ink heads and which irradiates light which is stronger than the light which is irradiated by the first irradiation units, and a transparent ink head which is disposed more to the downstream side in the transport direction than the second irradiation unit and which discharges transparent ink onto the image, wherein an interval, where a furthermost downstream color ink head and the transparent ink head are lined up, is wider than an interval where the plurality of color ink heads are lined up.

5 Claims, 5 Drawing Sheets

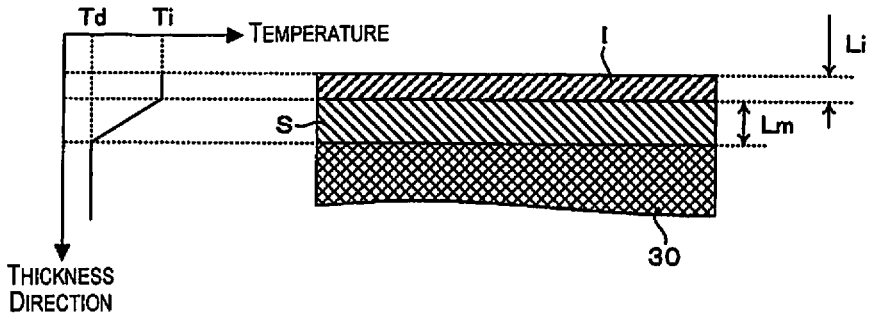
Fig. 4
| ITEM | REFERENCE NUMERAL | MATERIAL | NUMERICAL VALUE | UNIT |
|---|---|---|---|---|
| SHEET HEAD CONDUCTIVITY | λm | PAPER | 0.06 | W/m/K |
| SHEET THICKNESS | Lm | | 200 | μm |
| INK HEAT SPECIFIC | ci | ACRYLIC | 1460 | J/kg/K |
| INK DENSITY | ρi | ACRYLIC | 1200 | kg/m3 |
| INK THICKNESS | Li | | 10 | μm |
| TIME FOR 99% OF HEAD QUANTITY TO BE TRANSFERRED | t | | 0.27 | s |
Fig. 5
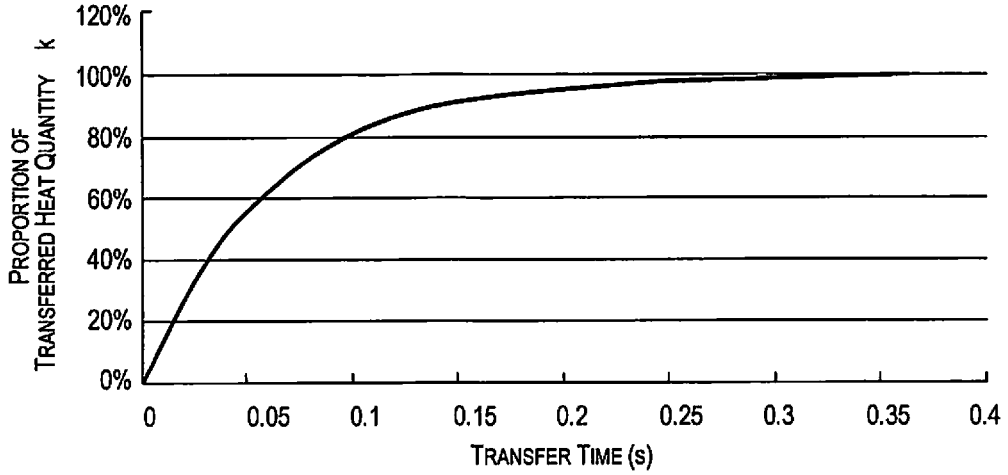
Fig. 6

| Item | Reference Numeral | Material | Numerical Value | Unit |
|---|---|---|---|---|
| Sheet Head Conductivity | λm | Polypropylene | 0.125 | W/m/K |
| Sheet Thickness | Lm | | 100 | μm |
| Ink Heat Specific | ci | Acrylic | 1460 | J/kg/K |
| Ink Density | ρi | Acrylic | 1200 | kg/m3 |
| Ink Thickness | Li | | 15 | μm |
| Time for 99% of Head Quantity to be Transferred | t | | 0.096 | s |

IMAGE RECORDING DEVICE INCLUDING LIGHT SOURCES

CROSS-REFERENCE TO RELATED APPLICATIONS

This application is a continuation application of U.S. patent application Ser. No. 13/862,704 filed on Apr. 15, 2013. This application claims priority to Japanese Patent Application No. 2012-098777 filed on Apr. 24, 2012. The entire disclosures of U.S. patent application Ser. No. 13/862,704 and Japanese Patent Application No. 2012-098777 are hereby incorporated herein by reference.

BACKGROUND

1. Technical Field

The present invention relates to an image recording device which fixes an image, which is formed using color ink, on a recording medium by curing a photo curable color ink which is discharged onto the recording medium using light irradiation, and in particular, relates to an image recording device which discharges transparent ink onto the image which is formed using color ink.

2. Background Technology

A printer is described in Patent Document 1 which transports the recording medium (film), which is wrapped around a platen drum, in a circumferential direction of the platen drum and which records the image on a front surface of the recording medium. A plurality of color ink heads which each discharge color inks such as black, yellow, magenta, and cyan are lined up in the printer in the circumferential direction of the platen drum. Furthermore, a color image is formed by the color ink heads discharging color ink onto the recording medium which is supported and transported by the platen drum. In addition, a clear ink head which discharges clear ink is disposed more to a downstream side in a transport direction of the recording medium than the color ink heads. The clear ink head is mainly for discharging the clear ink to overlap the color image in order to coat the color image.

In addition, ultraviolet ray curing ink, which is cured by irradiation of ultraviolet rays, is used in the printer as the color ink and the clear ink. Then, the ink which is discharged onto the recording medium is fixed onto the recording medium by curing using irradiation of ultraviolet rays. Here, the curing of the ink is gradually executed by changing the strength of the ultraviolet rays. Specifically, an ultraviolet light which irradiates relatively weak ultraviolet rays is disposed between each of the heads which are adjacent in the transmission direction of the recording medium. That is, the ultraviolet light is a weak ultraviolet light where relatively weak ultraviolet rays are irradiated onto the ink which is discharged onto the recording medium by the heads at an upstream side in the transport direction of the recording medium. On the other hand, an ultraviolet light which irradiates relatively strong ultraviolet is disposed more on the downstream side in the transport direction of the recording medium than the clear ink head. That is, the ultraviolet light is a strong ultraviolet light where relatively strong ultraviolet rays are irradiated onto the ink which color and clear ink heads have discharged onto the recording medium. In such a configuration, the ink which is discharged onto the recording medium is completely cured by receiving strong ultraviolet rays from the strong ultraviolet light, after a certain degree of curing by receiving weak ultraviolet from the weak ultraviolet light.

Japanese Laid-open Patent Publication No. 2011-067964 (Patent Document 1) is an example of the related art.

SUMMARY

However, the clear ink head as described above is often used for coating the image (color image) with clear ink. Accordingly, an area ratio (duty), where the clear ink is discharged with regard to the image, tends to be relatively high. However, there are cases where the ultraviolet rays from the ultraviolet light is not sufficiently irradiated onto the image when high duty clear ink is discharged to overlap the color image. In such a case, there is a concern that a difference occurs in curing speeds between the clear ink and the image, wrinkles are generated on a surface layer of the image, and image quality deteriorates.

The invention has been made in view of the problems described above and has an advantage to provide a technique which suppresses generation of wrinkles on the surface layer of an image and is able to realize high quality image formation.

In order to achieve the advantage described above, an image recording device according to the invention is provided with a support member which supports a recording medium by coming into contact with one surface of the recording medium, a transport section which transports the recording medium in a transport direction, a plurality of color ink heads, which are lined up in the transport direction and which each discharge photo curable color inks onto the other surface of the recording medium which is transported in the transport direction while being supported by the support member, first irradiation units which are disposed between the color ink heads which are adjacent and which irradiate light onto the color inks which are discharged from the color ink heads on the upstream side in the transport direction onto the recording medium, a second irradiation unit which is disposed more to the downstream side in the transport direction than the plurality of color ink heads and which irradiates light which is stronger than the light which is irradiated by the first irradiation units onto the image which is formed using the color inks which are discharged by the plurality of color ink heads, a transparent ink head which is disposed more to the downstream side in the transport direction than the second irradiation unit and which discharges transparent ink onto the image which is formed on the other surface of the recording medium which is transported in the transport direction while being supported by the support member, and a light irradiation unit which is disposed more on the downstream side in the transport direction than the transparent ink head and which cures the transparent ink which is discharged onto the image using light irradiation, wherein an interval, where a furthermost downstream color ink head which is disposed furthermost downstream among the plurality of color ink heads and the transparent ink head are lined up in the transport direction, is wider than an interval where the plurality of color ink heads are lined up in the transport direction.

In an invention (an image recording device) which is configured in this manner, the plurality of color ink heads are lined up in the transport direction of the recording medium, and the color ink heads form an image on the recording medium by discharging the color ink. In addition, the first irradiation units are disposed between the adjacent color ink heads and the first irradiation units irradiate light onto the color ink which is discharged from the color ink heads at the upstream side onto the recording medium. Due to this, the color ink is cured to a certain degree by receiving irradiation of light from the first irradiation units. The image which is formed using the color ink which is discharged from the plurality of color ink heads in this manner is transported to the downstream side in the transport direction and receives the discharging of the transparent ink from the transparent ink head.

At this time, as described above, there is a concern that a difference occurs in curing speeds between the transparent ink and the image in the light irradiation after the discharge of the transparent ink and that wrinkles are generated on a surface layer of the image when the transparent ink is discharged with regard to the image with high duty. In contrast to this, in the invention, the second irradiation unit is disposed between from the plurality of color ink heads up to the transparent ink head. Then, the light, which is stronger than the light which is irradiated by the first irradiation units, is irradiated from the second irradiation unit with regard to the image before receiving the discharge of the transparent ink. Accordingly, it is possible to speed up the curing of the image (in other words, a predetermined increase in curing is possible) before receiving the discharge of the transparent ink. As a result, it is possible to suppress differences in curing speeds between the transparent ink and the image in the light irradiation after discharge of the transparent ink, and it is possible to realize high quality image formation by suppressing the generation of wrinkles on a surface layer of the image.

However, the curing of the ink as described above is accompanied by the generation of heat through absorption of light and the generation of heat through a curing reaction. Accordingly, the head tends to be warmed by receiving heat which is emitted from the surroundings of the ink which is irradiated with light by each of the irradiation units. In contrast to this, there are cases where discharge characteristics of the ink from the heads fluctuate when the heads are warmed since viscosity of photo curable ink depends on temperature. In particular, a large quantity of heat is emitted from the image which receives the strong light irradiation from the second irradiation unit. As a result, it is thought that it is easy for the discharge characteristics of the ink of the heads (the furthermost downstream color ink head and transparent ink head), which is disposed in the surroundings of the second irradiation unit, to become unstable. Here, the furthermost downstream color ink head is the color ink head which is disposed the furthermost downstream in the transport direction among the plurality of color ink heads.

In contrast to this, in the invention, the interval, where the furthermost downstream color ink head and the transparent ink head are lined up in the transport direction, is wider than the interval where the plurality of color ink heads are lined up in the transport direction. The reason for such a configuration is as follows. That is, the light irradiation unit which is disposed between the plurality of color ink heads is the first irradiation unit which irradiates relatively weak light. Accordingly, heat which is emitted from the ink which receives irradiation of light between the plurality of color ink heads has a small effect which is imparted to the color ink heads. As a result, it is possible that the interval with which the plurality of color ink heads are lined up to be relatively narrow. Therefore, in the invention, a relatively wide interval is maintained between the furthermost downstream color ink head and the transparent ink head due to the plurality of color ink heads being lined up with a relatively narrow interval. Then, the second irradiation unit is disposed between the furthermost downstream color ink head and the transparent ink head which are maintained to be wider in this manner. As a result, it is possible to suppress a change in temperature in the furthermost downstream color ink head and the transparent ink head by suppressing heat transfer from the ink which receives the light irradiation of the second irradiation unit and it is possible to stabilize the discharge characteristics of the ink of the furthermost downstream color ink head and the transparent ink head.

That is, each of the heads receives a considerable effect from heat which is emitted from the ink when the ink, which receives light irradiation at the upstream side, passes in front. In contrast to this, the ink which receives light irradiation from the second irradiation unit does not pass by the furthermost downstream color ink head since the furthermost downstream color ink head is more to the upstream side in the transport direction than the second irradiation unit. Accordingly, it is relatively difficult for the furthermost downstream color ink head to receive an effect from the heat emission from the ink which receives the light irradiation of the second irradiation unit. On the other hand, the ink which receives the light irradiation from the second irradiation unit passes by the transparent ink head since the transparent ink head is more to the downstream side in the transport direction than the second irradiation unit. Accordingly, the transparent ink head tends to abnormally receive the effect from the heat emission from the ink which receives the light irradiation of the second irradiation unit. As a result, it is important to suppress the effect on the transparent ink head.

Therefore, the image recording device can be configured such that the interval where the second irradiation unit and the transparent ink head are adjacent is wider than the interval where the first irradiation units and the color ink heads are adjacent, in the transport direction. In this manner, it is possible to effectively suppress the effect where the heat emission is imparted from the ink, which receives the light irradiation from the second irradiation unit, to the transparent ink head by maintaining the interval to be wide where the second irradiation unit and the transparent ink head are adjacent.

In addition, the image recording device can be configured such that the second irradiation unit is disposed more to the furthermost downstream color ink head side in the transport direction than the midway point between the furthermost downstream color ink head and the transparent ink head. Even with a configuration such as this, it is possible to effectively suppress the effect where the heat emission is imparted from the ink, which receives the light irradiation from the second irradiation unit, to the transparent ink head by maintaining the interval to be wide where the second irradiation unit and the transparent ink head are adjacent.

However, in the invention as described above, the support member is in contact with the recording medium. Accordingly, most of the heat which the ink generates is absorbed by the support member through the recording medium. Here, by utilizing such a phenomenon, a configuration is possible such that the ink is sufficiently cooled before the ink which receives the irradiation of light from the second irradiation unit passes by the transparent ink head.

Specifically, the image recording device can be configured such that a time t, where the recording medium moves from a position where the second irradiation unit irradiates light to a position where the transparent ink head discharges the transparent ink, satisfies a relational expression of $t > -(Ci \cdot \rho i \cdot Li \cdot Lm/\lambda m)\log_e(1/100)$ where $\lambda m$ is the heat conductivity of the recording medium, Lm is the thickness of the recording medium, Li is the thickness of the color ink which forms the image, Ci is the density of the color ink which forms the image, and $\rho i$ is the specific heat of the color ink. Due to this, it is possible to sufficiently cool ink before the ink which receives the irradiation of light from the second irradiation unit passes by the transparent ink head. As a result, it is possible to effectively suppress the effect of imparting the heat emission from the ink, which receives the light irradiation from the second irradiation unit, to the transparent ink head.

BRIEF DESCRIPTION OF THE DRAWINGS

Referring now to the attached drawings which form a part of this original disclosure:

FIG. 4 is a diagram illustrating a state where a color image is formed on a sheet which is supported on the platen drum;

FIG. 5 is a diagram illustrating a numerical example of a case where the image is formed by acrylic ink on paper;

FIG. 6 is a diagram illustrating changes over time of the proportion a ratio time change of heat which is transferred from the image to the platen drum;

DETAILED DESCRIPTION OF EXEMPLARY EMBODIMENTS

Figure 1:
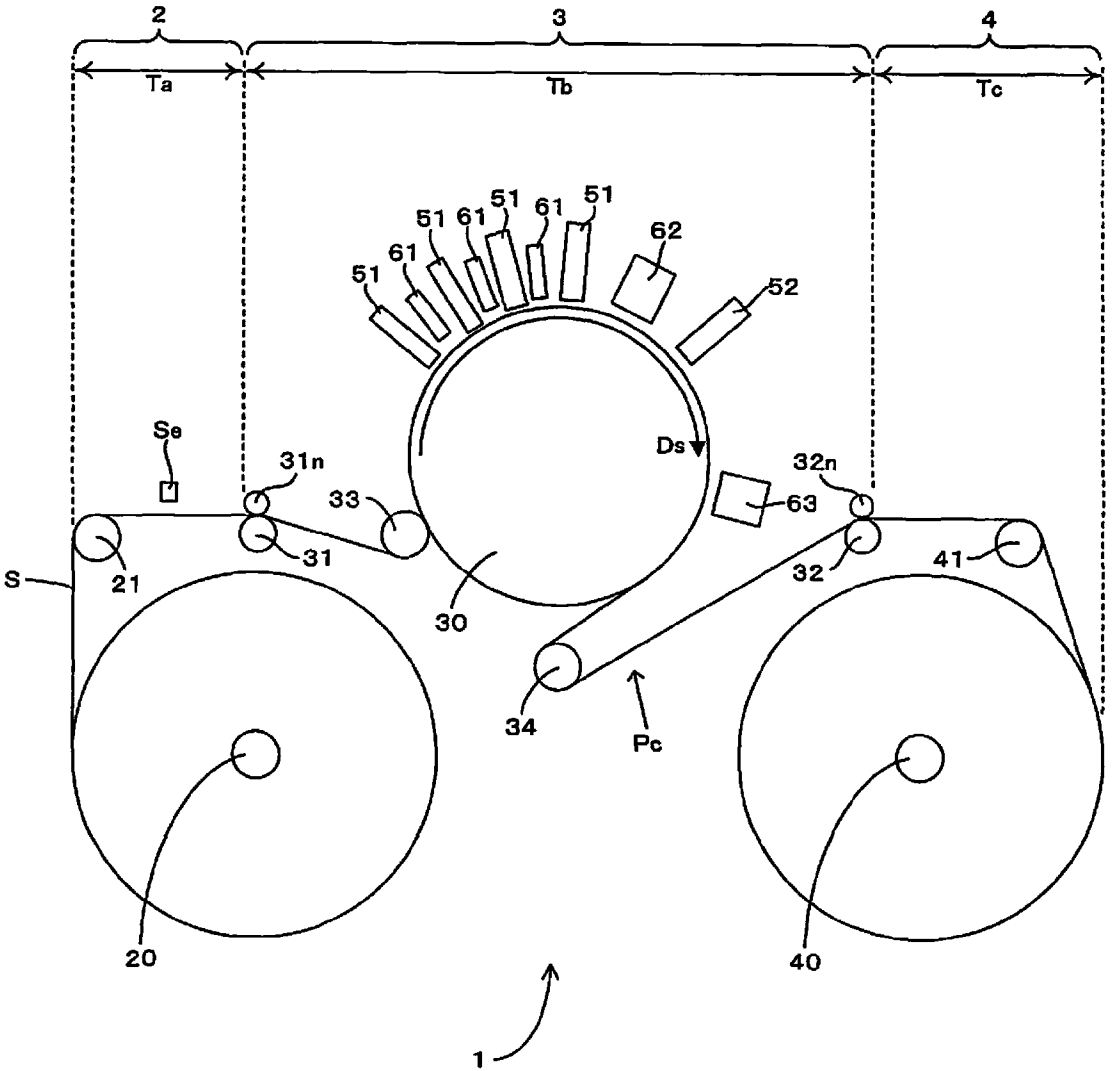
FIG. 1 is a diagram schematically illustrating an example of a configuration of a device which is provided in a printer where the invention is able to be applied.

FIG. 1 is a front surface diagram which schematically illustrates an example of a configuration of a device which is provided in a printer where the invention is able to be applied. As shown in FIG. 1, in a printer 1, one sheet M (a web), where both ends are wound in a roll shape around a feeding shaft 20 and a winding shaft 40, is stretched between the feeding shaft 20 and the winding shaft 40 and is transported from the feeding shaft 20 to the winding shaft 40 along a path Pc where the sheet M is stretched is such a manner. Then, an image is recorded with regard to the sheet M which is transported along the transport path Pc in the printer 1. The types of the sheet M are divided broadly into paper-based and film-based. Giving specific examples, paper-based can be high-quality paper, cast paper, art paper, coated paper, and the like, and film-based can be compound paper, PET (polyethylene terephthalate), PP (polypropylene), and the like. Generally, the printer 1 is provided with a feeding section 2 which feeds out the sheet M from the feeding shaft 20, a processing section 3 which records the image on the sheet M which is fed out from the feeding section 2, and a winding section 4 which winds the sheet M, where the image is recorded using the processing section 3, around the winding shaft 40. Here, in the description below, a surface where the image is recorded among both surfaces of the sheet M is called a front surface and a surface on the reverse side thereof is called a rear surface.

The feeding section 2 has the feeding shaft 20 which is wound around an edge of the sheet M, and a driven roller 21 which the sheet M, which is drawn out from the feeding shaft 20, is wound around. The feeding shaft 20 supports the edge of the sheet M by being wound around in a state where the front surface of the sheet M is towards the outside. Then, the sheet M, which is wound around the feeding shaft 20, is fed out to the processing section 3 through the driven roller 21 by the feeding shaft 20 being rotated in a clockwise direction in FIG. 1. That is, the sheet M is wound around the feeding shaft 20 via a core pipe (which is omitted from the diagram) which is freely attached and detached. Accordingly, it is possible to replace the sheet M on the feeding shaft 20 by installing a new core pipe, where the sheet M with the roll shape is wound, on the feeding shaft 20 when the sheet M on the feeding shaft 20 is used up.

The processing section 3 records the image on the sheet M by a platen drum 30 supporting the sheet M which is fed out from the feeding section 2 and performing appropriate processing using each of the functional sections 51, 52, 61, 62, and 63 which are disposed along an outer circumference surface of the platen 30. In the processing section 3, a front drive roller 31 and a rear drive roller 32 are provided on both sides of the platen drum 30, and image recording is received by the sheet M, which is transported from the front drive roller 31 to the rear drive roller 32, being supported on the platen drum 30.

The front drive roller 31 has a plurality of micro protrusions which are formed by thermal spraying on the outer circumference surface, and the sheet M, which is fed out from the feeding section 2, is wrapped from the rear surface side. Then, the sheet M which is fed out from the feeding section 2 is transported to a downstream side of the transport path by the front drive roller 31 being rotated in a clockwise direction in FIG. 1. Here, a nip roller 31*n* is provided with regard to the front drive roller 31. The nip roller 31*n* impacts against the front surface of the sheet M in a state of being pressed to the front drive roller 31 side and the sheet M is interposed between the nip roller 31*n* and the front drive roller 31. Due to this, frictional force is maintained between the front drive roller 31 and the sheet M and it is possible to reliably perform transport of the sheet M using the front drive roller 31.

The platen drum 30 is a drum with a cylindrical shape and a diameter of, for example, 400 mm which is supported to freely rotate by a support mechanism which is not shown in the diagram, and the sheet M, which is transported from the front drive roller 31 to the rear drive roller 32, is wrapped from the rear surface side. The platen drum 30 is driven and rotates in a transport direction Ds of the sheet M by receiving the frictional force between the platen drum 30 and the sheet M, and supports the sheet M from the rear surface side. That is, driven rollers 33 and 34, which fold back the sheet M at both sides of a wrapping section to the platen drum 30, are provided in the processing section 3. Among these, the driven roller 33 folds back the sheet M by wrapping the front surface of the sheet M between the front drive roller 31 and the platen drum 30. On the other hand, the driven roller 34 folds back the sheet M by wrapping the front surface of the sheet M between the platen drum 30 and the rear drive roller 32. In this manner, it is possible to maintain the wrapping section of the sheet M to the platen 30 to be long by folding back the sheet M on each of the upstream side and the downstream side in the transport direction Ds with regard to the platen drum 30.

The rear drive roller 32 has a plurality of micro protrusions which are formed by thermal spraying on the outer circumference surface, and the sheet M, which is transported from the platen drum 30 through the driven roller 34, is wrapped from the rear surface side. Then, the sheet M is transported to the winding section 4 by the rear drive roller 32 being rotated in a clockwise direction in FIG. 1. Here, a nip roller 32*n* is provided with regard to the rear drive roller 32. The nip roller 32*n* impacts against the front surface of the sheet M in a state of being pressed to the rear drive roller 32 side, and the sheet M is interposed between the nip roller 32*n* and the rear drive roller 32. Due to this, frictional force between the rear drive roller 32 and the sheet M is maintained and it is possible to reliably perform transporting of the sheet M using the rear drive roller 32.

In this manner, the sheet M which is transported from the front drive roller 31 to the rear drive roller 32 is supported on the outer circumference surface of the platen drum 30. Then, a plurality of recording heads 51 are provided in the processing section 3 to correspond to colors which are different to each other in order to record a color image with regard to the front surface of the sheet M which is supported on the platen drum 30. Specifically, four of the recording heads 51 which correspond to yellow, cyan, magenta, and black are lined up in the transport direction Ds in this color order. Each of the recording heads 51 are opposed by having a slight clearance with regard to the front surface of the sheet M which is wrapped around the platen drum 30, and ink of the corresponding color (the color ink) is discharged from a nozzle with an ink jet method. Then, the color image is formed on the front surface of the sheet M by each of the recording heads 51 discharging ink with regard to the sheet M which is transported in the transport direction Ds.

That is, UV (ultraviolet) ink (curable ink) which is cured by irradiating ultraviolet (light) is used as the ink. Therefore, UV lamps 61 and 62 (light irradiation unit) are provided in the processing section 3 in order to fix the sheet M by curing the ink. Here, the curing of the ink is executed by being divided into two steps of pre-curing and main curing. The UV lamps 61 for pre-curing are disposed between each of the plurality of recording heads 51. That is, due to the UV lamps 61 irradiating weak ultraviolet rays, the ink is cured (pre-cured) to an extent where the shape of the ink does not collapse, and the ink is not completely cured. On the other hand, the UV lamp 62 for main curing is provided on the downstream side in the transport direction Ds with regard to the plurality of recording heads 51. That is, the UV lamp 62 completely cures (main cures) the ink by irradiating ultraviolet rays which are stronger than the UV lamps 61.

In this manner, the UV lamps 61 which are disposed between each of the plurality of recording heads 51 pre-cure the color ink which is discharged onto the sheet M from the recording heads 51 on the upstream side in the transport direction Ds. Accordingly, the ink which is discharged onto the sheet M from one of the recording heads 51 is pre-cured up to the recording head 51 which is adjacent to the one recording head 51 on the downstream side in the transport direction Ds. Due to this, generation of mixed colors, where color inks of different colors are mixed, is suppressed. In this manner, a color image is formed on the sheet M by the plurality of recording heads 51 discharging color ink of colors which are different to each other in a state where the mixed colors are suppressed. Furthermore, the UV lamp 62 for main curing is provided more to the downstream side in the transport direction Ds than the plurality of recording heads 51. As a result, the color image which is formed by the plurality of recording heads 51 is fixed on the sheet M by main curing using the UV lamp 62.

Furthermore, a recording head 52 is provided on the downstream side in the transport direction Ds with regard to the UV lamp 62. The recording head 52 is opposed by having a slight clearance with regard to the front surface of the sheet M which is wrapped on the platen drum 30, and transparent UV ink is discharged from the nozzle with the ink jet method onto the front surface of the sheet M. That is, transparent ink is further discharged with regard to the color image which is formed by the recording heads 51 of four colors. The transparent ink imparts a gloss or matte finish to the color image by being discharged over the entire surface of the color image. In addition, a UV lamp 63 is provided on the downstream side in the transport direction Ds with regard to the recording head 52. The transparent ink which is discharged by the recording head 52 is completely cured (main cured) by the UV lamp 63 irradiating strong ultraviolet rays. Due to this, it is possible to fix the transparent ink on the front surface of the sheet M.

In this manner, a color image which is coated with transparent ink is formed by appropriately executing discharging and curing of the ink with regard to the sheet M which is wrapped around the outer circumference section of the platen drum 30 in the processing section 3. Then, the sheet M which is formed of a color image is transported to the winding section 4 by the rear drive roller 32.

The winding section 4 has a driven roller 41 which wraps the sheet M from the rear surface side between the winding shaft 40 and the rear drive roller 32, in addition to the winding shaft 40 which winds the edge of the sheet M. The winding shaft 40 supports the edge of the sheet M by winding in a state where the front surface of the sheet M is towards the outside. That is, the sheet M which is transported from the rear drive roller 32 is wound around by the winding shaft 40 through the driven roller 41 when the winding shaft 40 rotates in a clockwise direction in FIG. 1. That is, the sheet M is wound around the winding shaft 40 via the core pipe (which is omitted from the diagram) which is freely attached and detached to and from the winding shaft 40. Accordingly, it is possible to remove the sheet M from every core pipe when the sheets M which are wound on the winding shaft 40 are full to capacity.

Figure 2:
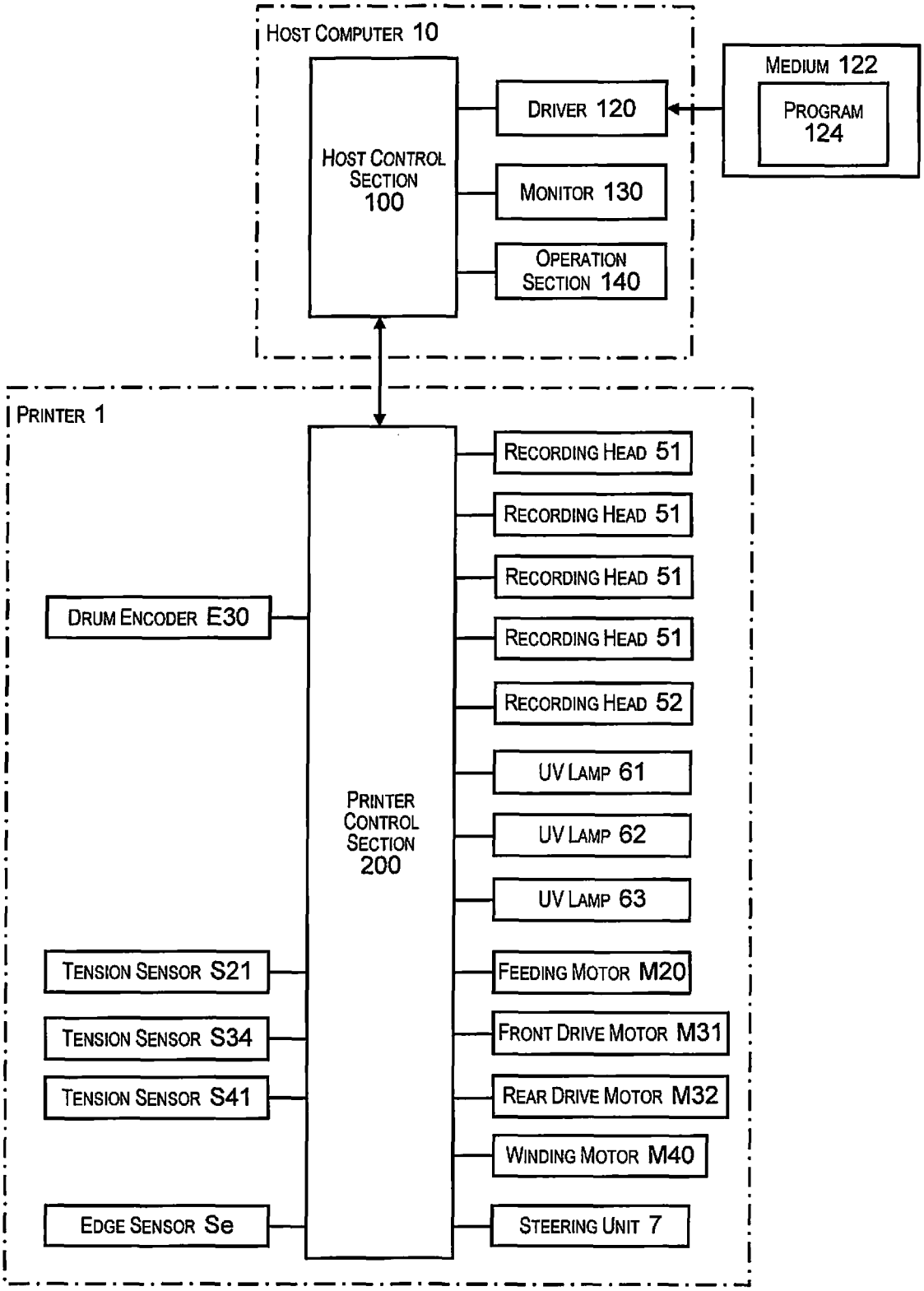
FIG. 2 is a diagram schematically illustrating an electrical configuration which controls the printer shown in FIG. 1.

The above is an outline of a device configuration of the printer 1. Next, description will be performed with regard to an electrical configuration which controls the printer 1. FIG. 2 is a block diagram schematically illustrating an electrical configuration which controls the printer shown in FIG. 1. The actions of the printer 1 described above are controlled by a host computer 10 shown in FIG. 2. A host control section 100 which supervises the control actions is configured by a CPU (Central Processing Unit) and a memory in the host computer 10. In addition, the host computer 10 is provided with a driver 120, and the driver 120 reads out a program 124 from a medium 122. Here, it is possible to use various types of media such as a CD (Compact Disc), a DVD (Digital Versatile Disc), or a USB (Universal Serial Bus) memory as the medium 122. Then, the host control section 100 performs control of each section of the host computer 10 and control of the actions of the printer 1 based on the program 124 which is read out from the medium 122.

Furthermore, a monitor 130 which is configured by a liquid crystal display or the like and an operation section 140 which is configured by a keyboard, mouse, or the like are provided in the host computer 10 as an interface with the operator. A menu screen other than of an image of the printing target is displayed on the monitor 130. Accordingly, the operator is able to set various types of printing conditions such as the type of printing medium, the size of the printing medium, and the printing quality by opening a printing settings screen from the menu screen by checking the monitor 130 and operating the operation section 140. Here, it is possible to make various modifications to the specific configuration of the interface with the operator, for example, a touch panel type display can be used as the monitor 130, and the operation section 140 can be configured with the touch panel of the monitor 130.

On the other hand, a printer control section 200, which controls each section of the printer 1 according to a command from the host computer 10, is provided in the printer 1. Then, each section of the recording heads, the UV lamps, and a sheet transport system is controlled by the printer control section 200. The details of the control of the printer control section 200 with regard to each section of the device are as follows.

The printer control section 200 controls ink discharge timing of each of the recording heads 51 which form the color image according to the transport of the sheet M. Specifically the control of the ink discharge timing is executed based on an output of a drum encoder E30 (a detection value) which detects a rotation position of the platen drum 30 by being attached to a rotation shaft of the platen drum 30. That is, it is possible to grasp the transport position of the sheet M by referencing the output of the drum encoder E30 which detects the rotation position of the platen drum 30 in order for the platen drum 30 to drive and rotate in accompaniment with the transport of the sheet M. Therefore, the printer control section 200 forms a color image by landing the ink which is discharged from the plurality of recording heads 51 at a target position of the sheet M which is transported by generating a pts (print timing signal) signals from the output of the drum encoder E30 and controlling the ink discharge timing of each of the recording heads 51 based on the pts signal.

In addition, a timing in which the recording head 52 discharges the transparent ink is also controlled by the printer control section 200 based on the output of the drum encoder E30 in the same manner. Due to this, it is possible to accurately discharge the transparent ink with regard to the color image which is formed by the plurality of recording heads 51. Furthermore, the timing of lighting and extinguishing of the UV lamps 61, 62, and 63 and irradiation light amount thereof are also controlled by the printer control section 200.

In addition, the printer control section 200 is responsible for the function of controlling the transporting of the sheet M which has been described in detail used in FIG. 1. That is, among members which configure a sheet transport system, the feeding shaft 20, the front drive roller 31, the rear drive roller 32, and the winding shaft 40 are each connected to a motor. Then, the printer control section 200 controls the transporting of the sheet M by rotating the motors and controlling speed and torque of each motor. Details of transport control of the sheet M is as follows.

The printer control section 200 supplies the sheet M from the feeding shaft 20 to the front drive roller 31 by rotating a feeding motor M20 which drives the feeding shaft 20. At this time, the printer control section 200 adjusts the tension (a feeding tension Ta) of the sheet M from the feeding shaft 20 to the front drive roller 31 by controlling the torque of the feeding motor M20. That is, a tension sensor S21 which detects the feeding tension Ta is attached to the driven roller 21 which is disposed between the feeding shaft 20 and the front drive roller 31. It is possible for the tension sensor S21 to be configured using, for example, a load cell which detects a force which is received from the sheet M. Then, the printer control section 200 adjusts the feeding tension Ta of the sheet M by controlling feedback of the torque of the feeding motor M20 based on a detection result of the tension sensor S21.

At this time, the printer control section 200 performs feeding out of the sheet M while adjusting a position in a width direction (an orthogonal direction of the paper surface in FIG. 1) of the sheet M which is supplied from the feeding shaft 20 to the front drive roller 31. That is, a steering unit 7, which changes the position of each of the feeding shaft 20 and the driven roller 21 in an axial direction (in other words, the width direction of the sheet M), is provided in the printer 1. In addition, an edge sensor Se, which detects an edge in the width direction of the sheet M, is disposed between the driven roller 21 and the front drive roller 31. It is possible for the edge sensor Se to be configured as, for example, a distance sensor such as an ultrasound sensor. Then, the printer control section 200 adjusts the position of the width direction of the sheet M by controlling feedback of the steering unit 7 based on the detection result of the edge sensor Se. Due to this, transport defects such as meandering of the sheet M are suppressed by making the position appropriate in the width direction of the sheet M.

In addition, the printer control section 200 rotates a front drive motor M31 which drives the front drive roller 31 and a rear drive motor M32 which drives the rear drive roller 32. Due to this, the sheet M which is fed from the feeding section 2 passes by the processing section 3. At this time, speed control is executed with regard to the front drive motor M31 and torque control is executed with regard to the rear drive motor M32. That is, the printer control section 200 constantly adjusts the rotation speed of the front drive motor M31 based on an encoder output of the front drive motor M31. Due to this, the sheet M is transported at a constant speed (for example, 250 mm/s) by the front drive roller 31.

On the other hand, the printer control section 200 adjusts tension (a process tension Tb) of the sheet M from the front drive roller 31 to the rear drive roller 32. That is, a tension sensor S34 which detects the process tension Tb is attached in the driven roller 34 which is disposed between the platen drum 30 and the rear drive roller 32. It is possible for the tension sensor S34 to be configured using, for example, a load cell which detects the force which is received from the sheet M. Then, the printer control section 200 adjusts the process tension Tb of the sheet M by controlling feedback of the torque of the rear drive motor M32 based on a detection result of the tension sensor S34.

In addition, the printer control section 200 winds the sheet M, which is transported by the rear drive roller 32, around the winding shaft 40 by rotating a winding motor M40 which drives the winding shaft 40. At this time, the printer control section 200 adjusts a tension (a winding tension Tc) of the sheet M from the rear drive roller 32 to the winding shaft 40 by controlling the torque of the winding motor M40. That is, a tension sensor S41 which detects the winding tension Tc is attached to the driven roller 41 which is disposed between the rear drive roller 32 and the winding shaft 40. It is possible for the tension sensor S41 to be configured using, for example, a load cell which detects the force which is received from the sheet M. Then, the printer control section 200 adjusts the winding tension Tc of the sheet M by controlling feedback of the torque of the winding motor M40 based on the detection result of the tension sensor S41.

Figure 3:
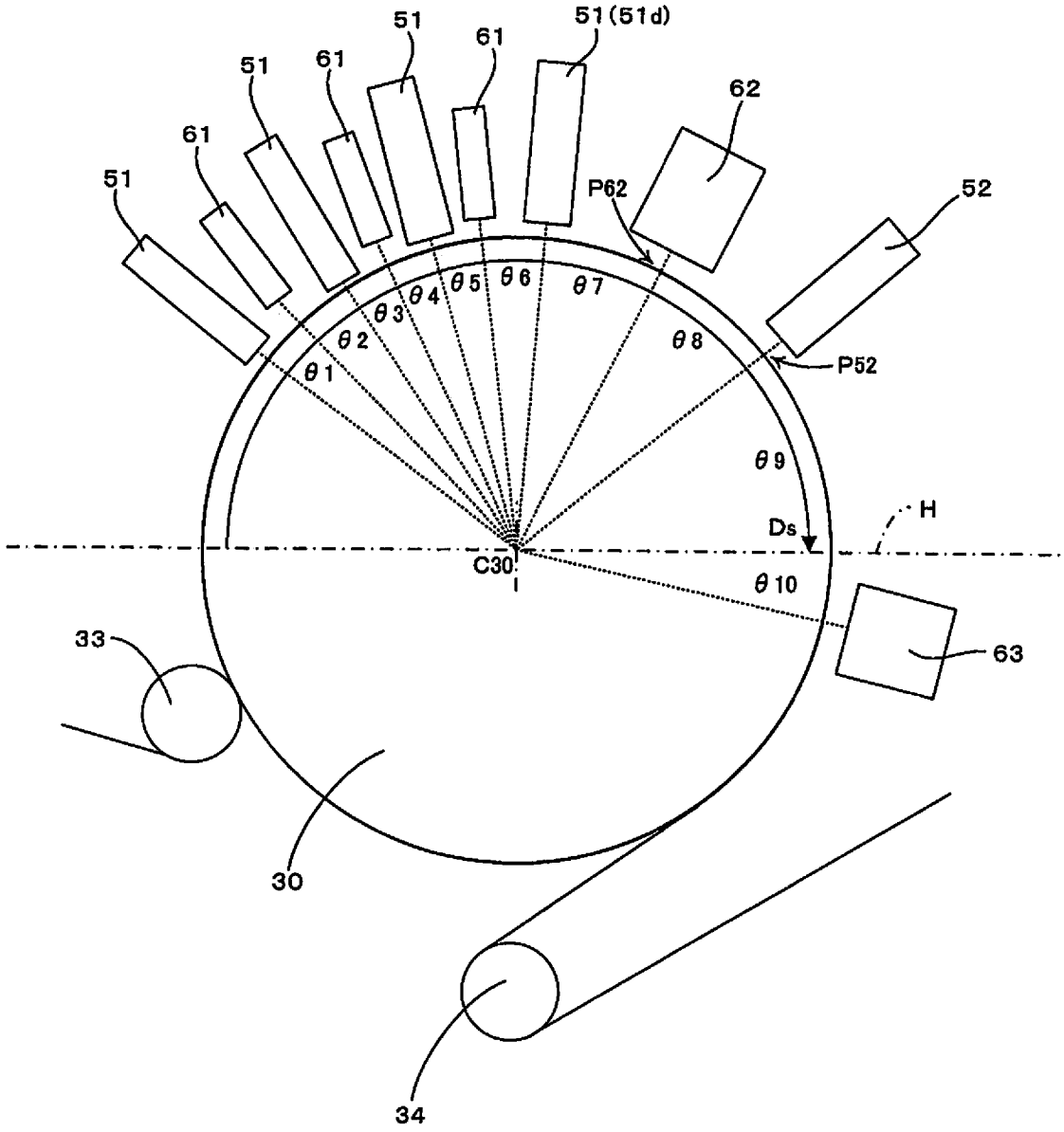
FIG. 3 is a diagram illustrating a positional relationship between a recording head and a UV lamp in the surroundings of a platen drum.

The above is an outline of the electrical configuration of the printer 1. Next, positional relationships between the recording heads 51 and 52 and the UV lamps 61, 62, and 63 which are provided in the surroundings of the platen drum 30 will be described in detail. FIG. 3 is a front surface diagram schematically illustrating a positional relationship between the recording heads and the UV lamps in the surroundings of the platen drum. The positional relationships between each of the functional sections 51, 52, 61, 62, and 63 at angles θ1 to θ10 around a cylindrical central shaft C30 of the platen drum 30 are shown in the diagram.

That is, it is possible to determine the angles of each of the functional sections 51, 52, 61, 62, and 63 around the cylindrical central shaft C30, for example, in the following manner. That is, the angle of the recording head 51 is found as the angle of a virtual straight line, which passes through a geometric center of gravity of an image which is formed by discharging ink onto the sheet M which is stationary from all of the nozzles of the recording head 51 and the cylindrical central shaft C30, and the cylindrical central shaft C30. The angle of the recording head 52 is also found in a similar manner to the recording head 51. In addition, the angle of the UV lamp 61 is found as the angle of the virtual straight line, which passes through a center of an intensity distribution of ultraviolet rays which the UV lamp 61 irradiates onto the sheet M in the transport direction Ds and the cylindrical central shaft C30, and the cylindrical central shaft C30. The angles of each of the UV lamps 62 and 63 are also found in a similar manner to the UV lamp 61.

In the present embodiment, the four recording heads 51 are lined up at equal intervals in the transport direction Ds, and the intervals (θ1+θ2), (θ3+θ4), (θ5+θ6) of the recording heads 51 which are adjacent in the transport direction Ds are all 16 degrees. In addition, three UV lamps 61 which are disposed one by one between each of the four recording heads 51 are lined up at equal intervals in the transport direction Ds, and the intervals (θ2+θ3) and (θ4+θ5) of the UV lamps 61 which are adjacent in the transport direction are all 16 degrees. At this time, each of the UV lamps 61 are disposed at the midway point of the recording heads 51 which are adjacent in the transport direction Ds. Accordingly, the intervals θ1 to θ6 of the recording heads 51 and the UV lamps 61 which are adjacent in the transport direction Ds are equal to each other and are all 8 degrees.

In addition, the interval (θ7+θ8) of a recording head 51*d*, which is positioned furthermost downstream in the transport direction Ds from among the four recording heads 51, and the recording head 52 is wider than the interval (=16 degrees) where the four recording heads 51 are lined up, and is 52 degrees. Then, the UV lamp 62 is disposed at a relatively wide interval (θ7+θ8) which is provided between the recording head 51*d* and the recording head 52. At this time, the UV lamp 62 is disposed more to the recording head 51*d* side than the midway point between the recording head 51*d* and the recording head 52 in the transport direction Ds. As a result, with regard to the interval θ7 between the recording head 51*d* and the UV lamp 62 being 24 degrees, the interval θ8 between the UV lamp 62 and the recording head 52 is 28 degrees (θ7<θ8). In addition, the interval (θ9+θ10) between the recording head 52 and the UV lamp 63 is 57 degrees.

Here, the recording heads 51 and 52 oppose the circumference surface of the platen drum 30 at an upper side by a horizontal line H which extends in a horizontal direction passing along the cylindrical central shaft C30. Accordingly, the recording heads 51 and 52 discharge ink toward a lower side in a vertical direction. In addition, the UV lamps 61 and 62 oppose the circumference surface of the platen drum 30 at the upper side by the horizontal line H, and the UV lamp 63 opposes the circumference surface of the platen drum 30 at the lower side by the horizontal line H. At this time, the interval θ9 between the recording head 52 and the horizontal line H is 45 degrees, and the interval θ10 between the horizontal line H and the UV lamp 63 is 12 degrees.

Here, the color image which is formed by the four recording heads 51 is cured by receiving ultraviolet rays which are irradiated from the UV lamp 62. At this time, an amount of heat generation which accompanies curing of the color image is abnormally large since the strong ultraviolet rays for main curing are irradiated from the UV lamp 62 and there are cases where the temperature of the color image reaches up to the vicinity of 100 degrees. However, the quantity of heat which is emitted from the color image falls relatively quickly since the heat from the color image is transferred to the platen drum 30 through the sheet M. In particular, in the present embodiment, the interval θ8 from the UV lamp 62 to the recording head 52 is taken to be wider, and it is possible to sufficiently cool the color image before passing by the recording head 52 so as not to affect discharge characteristics of the ink of the recording head 52 due to the heat from the color image when the color image passes by the recording head 52. Next, this feature will be described below.

FIG. 4 is a diagram illustrating a state where the color image is formed on the sheet which is supported on the platen drum. In the diagram, an ink layer I which configures the color image, the sheet M, and the platen drum 30 are illustrated in a cross section, and a graph is plotted which illustrates the change in temperature in the thickness direction for each section I, M, and 30. In the description below using FIG. 4, heat capacity of the ink layer I is approximated by a concentrated temperature capacity model, and a temperature Ti of the ink layer I is uniformly set in the thickness direction. In addition, the temperature distribution of the sheet M is approximated by a linear change in the thickness direction. Further, the platen drum 30 has a sufficiently large temperature capacity compared to the ink layer and a temperature TD of the platen drum 30 is constant as a function as a hot bath.

A heat quantity Q which is transferred from a heat generating body with an area S and a volume V to the hot bath via an inclusion body of a heat conductivity λ and a thickness L is expressed by the following expression 1 by performing approximation with a lumped parameter system.

$$Q = \frac{\lambda}{L} S(T - T_\infty) = -c\rho V \frac{dT}{dt} \quad \text{[Equation 1]}$$

Here, the heat generating body is the ink layer I, the inclusion body is the sheet M, and the heat bath is the platen drum 30, and when applying the model of FIG. 4 in expression 1, the following expression 2 is obtained since the volume V of the ink layer I is expressed as a product of the area S and the thickness Li (V=S·Li).

$$\frac{\lambda_m}{L_m}(T_i - T_d) = -c_i \rho_i L_i \frac{dT_i}{dt} \quad \text{[Equation 2]}$$

The following expression 3 is obtained with the temperature Td of the platen drum 30 as a base when the quantity of heat of the ink layer I is set as Qi.

$$Q_i = c_i \rho_i L_i S(T_i - T_d) \quad \text{[Equation 3]}$$

The following expression 4 is obtained when both sides of the expression 3 are differentiated by a time t.

$$\frac{dQ_i}{dt} = c_i \rho_i L_i S \frac{dT_i}{dt} \quad \text{[Equation 4]}$$

The following expression 5 is obtained when expression 2 is modified using expression 3 and expression 4.

$$\frac{\lambda_m}{L_m} \frac{Q_i}{c_i \rho_i L_i} = -\frac{dQ_i}{dt} \quad \text{[Equation 5]}$$

The following expression 6 is obtained when the differentiated equation which is expressed in expression 5 is analytically solved.

$$\frac{Q_i}{Q_0} = e^{-\frac{\lambda_m}{c_i \rho_i L_i L_m} t} \quad \text{[Equation 6]}$$

Here, in expression 6, $Q_o$ is a quantity of heat which the ink layer I has at a timing 0 and is the quantity of heat which is generated by absorption heat due to absorption of ultraviolet rays, and reaction heat due to a curing reaction. Then, a proportion k of a heat quantity ($Q_o - Q_i$) which is transferred to the platen drum 30 with regard to the heat amount $Q_o$ which is generated in the ink layer I is expressed in the following expression 7 by modifying expression 6.

$$k = \frac{Q_0 - Q_i}{Q_0} = 1 - e^{-\frac{\lambda_m}{c_i \rho_i L_i L_m} t} \quad \text{[Equation 7]}$$

Accordingly, the following expression 8 is a condition for transfer of 99% of the quantity of heat out of the heat amount $Q_o$ which is generated in the ink layer I from the ink layer I to the platen drum 30.

$$0.99 < 1 - e^{-\frac{\lambda_m}{c_i \rho_i L_i L_m} t} \quad \text{[Equation 8]}$$

The following expression 9 is obtained by modifying the time t in expression 8. Then, in the present embodiment, the interval θ8 between the lamp 62 and the recording head 52 in the transport direction Ds is set so that the time t, where the sheet M is moved from a position P62 where the UV lamp 62 irradiates light to a position P52 where the recording head 52 discharges ink, satisfies expression 9.

$$t > -\frac{c_i \rho_i L_i L_m}{\lambda_m} \log e \frac{1}{100} \quad \text{[Equation 9]}$$

As described above, in the present embodiment, the plurality of color recording heads 51 are lined up in the transport direction Ds of the sheet M and the recording heads 51 form the color image on the sheet M by discharging the color ink. In addition, the UV lamps 61 for pre-curing are disposed between the adjacent recording heads 51, and the UV lamps 61 irradiate ultraviolet rays onto the color ink which is discharged from the recording heads 51 at the upstream side to the sheet M. Due to this, a certain degree of curing occurs by the color ink receiving irradiation of ultraviolet rays from the UV lamp 61. The color image which is formed with color ink which is discharged by the plurality of recording heads 51 in this manner is transported to the downstream side in the transport direction Ds and receives the discharging of the transparent ink from the transparent recording head 52.

At this time, as described above, there is a concern that a difference occurs in curing speeds between the transparent ink and the color image in the light irradiation after the discharge of the transparent ink and that wrinkles are generated on the surface layer of the image when the transparent ink is discharged with regard to the image with high duty. In contrast to this, in the present embodiment, the UV lamp 62 for main curing is disposed between from the plurality of color ink heads 51 up to the transparent recording head 52. Then, the ultraviolet rays, which are stronger than the ultraviolet rays which are irradiated by the UV lamps 61, are irradiated from the UV lamp 62 with regard to the color image before receiving the discharge of the transparent ink. Accordingly, it is possible to speed up the curing of the color image (in other words, a predetermined increase in curing is possible) before receiving the discharge of the transparent ink. As a result, it is possible to suppress differences in curing speeds between the transparent ink and the color image in the ultraviolet light irradiation after discharge of the transparent ink, and it is possible to realize high quality image formation by suppressing the generation of wrinkles on the surface layer of the color image.

However, the curing of the ink as described above is accompanied by the generation of heat through absorption of ultraviolet rays and the generation of heat through a curing reaction. Therefore, there is a tendency that the recording heads 51, 52 are warmed by receiving heat released from the ink irradiated with the ultraviolet rays from each of the UV lamps 61, 62, and 63 disposed around the recording heads 51, 52. Since the viscosity of photo curable ink depends on the temperature, there are cases in which the discharge characteristics of ink from the recording heads 51, 52 change when the recording heads 51, 52 are warmed. In particular, a great amount of heat is released from a color image irradiated with the strong ultraviolet rays from the UV lamp 62 for main curing. Accordingly, it is considered that the discharge characteristics of ink from the recording heads 51*d*, 52 disposed around the UV lamp 62 will easily become unstable. In order to address this situation, according to the present embodiment, the interval (θ7+θ8) of the recording head 51*d* and the recording head 52 lined up in the transport direction Ds is wider than the interval (θ1+θ2) and the like of the plurality of recording heads 51 lined up in the transport direction Ds. The reason for this configuration is as follows. The UV lamps 61 which are disposed between the plurality of recording heads 51 irradiate relatively weak ultraviolet rays. Accordingly, the effect of the heat, which is emitted from the ink which receives the irradiation of the ultraviolet rays between the plurality of recording heads 51, which is imparted to the recording heads 51 is small. As a result, it is possible for the interval with which the plurality of recording heads 51 are lined up to be relatively narrow. Therefore, in the present embodiment, a relatively wide interval (θ7+θ8) is maintained between the recording head 51*d* and the recording head 52 due to the plurality of recording heads 51 being lined up with a relatively narrow interval. Then, the UV lamp 62 for main curing is disposed between the recording head 51*d* and the recording head 52 which are maintained to be wide in this manner. As a result, it is possible to suppress a change in temperature in the recording head 51*d* and the recording head 52 by suppressing heat transfer from the ink which receives the ultraviolet irradiation from the UV lamp 62 and it is possible to stabilize the discharge characteristics of the ink of the recording head 51*d* and the recording head 52.

That is, each of the recording heads 51*d* and 52 receives a considerable effect from heat which is emitted from the ink when the ink, which receives ultraviolet irradiation at the upstream side in the transport direction Ds, passes in front. In contrast to this, the ink which receives ultraviolet irradiation from the UV lamp 62 does not pass by the recording head 51*d* since the recording head 51*d* is more to the upstream side in the transport direction Ds than the UV lamp 62 for main curing. Accordingly, it is relatively difficult for the recording head 51*d* to receive an effect from the heat emission from the ink which receives the ultraviolet irradiation from the UV lamp 62. On the other hand, the ink which receives the ultraviolet irradiation from the UV lamp 62 passes by the recording head 52 since the recording head 52 is more to the downstream side in the transport direction Ds than the UV lamp 62 for main curing. Accordingly, the recording head 52 tends to abnormally receive the effect from the heat emission from the ink which receives the ultraviolet irradiation from the UV lamp 62. As a result, it is important to suppress the effect on the recording head 52.

Therefore, in the present embodiment, the interval θ8 where the UV lamp 62 for main curing and the recording head 52 are adjacent is maintained to be wider in the transport direction Ds than the interval θ1, where the UV lamps 61 and the recording heads 51 for pre-curing are adjacent, and the like. In this manner, it is possible to effectively suppress the effect where the heat emission is imparted from the ink, which receives the ultraviolet irradiation from the UV lamp 62, to the recording head 52 by maintaining the wide interval θ8 where the UV lamp 62 for main curing and the recording head 52 are adjacent.

That is, in the present embodiment, the recording heads 51 and the UV lamps 61 are disposed alternately at equal intervals (=8 degrees) in the transport direction Ds. However, the intervals of the recording heads 51 and the UV lamps 61 which are adjacent in the transport direction Ds can each be different. At this time, for example, an interval, which is wider than the largest interval among adjacent intervals between the recording heads 51 and the UV lamps 61, can be maintained between the recording head 51*d* and the recording head 52. Then, the UV lamp 62 for main curing can be disposed between the recording head 51*d* and the recording head 52. By being configured in this manner, it is possible to effectively suppress a change in temperature in the recording head 51*d* and the recording head 52 caused by heat transfer from the ink which receives the ultraviolet irradiation of the UV lamp 62, and it is possible to reliably stabilize the discharge characteristics of the ink of the recording head 51*d* and the recording head 52.

In addition, in the present embodiment, the UV lamp 62 for main curing is disposed more on the recording head 52*d* side than the midway point between the recording head 51*d* and the recording head 52 in the transport direction Ds. As a result, it is possible to maintain the interval θ8, where the UV lamp 62 and the recording head 52 for main curing are adjacent, to be wide, and it is possible to effectively suppress the effect where the heat emission is imparted from the ink, which receives the ultraviolet irradiation from the UV lamp 62, to the recording head 52.

Here, in the present embodiment, the platen drum 30 comes into contact with the sheet M. Accordingly, most of the heat which the ink generates is absorbed in the platen drum 30 through the sheet M. Therefore, by utilizing such a phenomenon, a configuration is possible such that the ink is sufficiently cooled before the ink which receives the irradiation of ultraviolet rays from the UV lamp 62 for main curing passes by the recording head 52.

Specifically, the present embodiment is configured so as to satisfy expression 9. Due to this, it is possible to sufficiently (equal to or more than 99%) cool the ink before the ink which receives the irradiation of ultraviolet rays from the UV lamp 62 passes by the recording head 52. As a result, it is possible to effectively suppress the effect where the heat emission is imparted from the ink, which receives the ultraviolet irradiation from the UV lamp 62, to the recording head 52.

[Other Configurations]

As described above, in the embodiment described above, the printer 1 corresponds to the "image recording device" of the invention, the sheet M corresponds to the "recording medium" of the invention, the rear surface of the sheet M corresponds to the "one surface" of the invention, the front surface of the sheet M corresponds to the "other surface" of the invention, the platen drum 30 corresponds to the "support member" of the invention, the drive rollers 31 and 32 correspond to the "transport section" of the invention, the transport direction Ds corresponds to the "transport direction" of the invention, the recording heads 51 correspond to the "color ink heads" of the invention, the recording head 51*d* corresponds to the "furthermost downstream color ink head" of the invention, the recording head 52 corresponds to the "transparent ink head" of the invention, the UV lamps 61 correspond to the "first irradiation units" of the invention, the UV lamp 62 corresponds to the "second irradiation unit" of the invention, and the UV lamp 63 corresponds to the "light irradiation unit" of the invention.

Here, the invention is not limited to the embodiment described above and it is possible to add various modifications with regard to the embodiment as long as the modification does not depart from the gist of the invention. For example, in the embodiment described above, the UV lamp 62 irradiates strong ultraviolet rays for main curing, but the strength of ultraviolet rays which are irradiated from the UV lamp 62 need not be sufficient for main curing. In other words, it is possible to speed up the curing of the color image before the discharge of transparent ink is received by irradiating ultraviolet rays, which are stronger than the ultraviolet rays which are irradiated by the UV lamp 61, from the UV lamp 62. As a result, it is possible to suppress differences in curing speeds between the transparent ink and the color image in the ultraviolet irradiation after discharge of the transparent ink, and it is possible to realize high quality image formation by suppressing the generation of wrinkles on the surface layer of the color image.

In addition, each of the disposing and number of the recording heads 51 and 52 and the UV lamps 61, 62, and 63 are not limited to the examples described above and appropriate modifications are possible. Accordingly, it is possible to modify the intervals between the recording heads 51 and 52 and the UV lamps 61, 62, and 63 from the examples described above.

In addition, in the embodiment described above, the transparent ink is discharged onto the entire surface of the color image. However, it is not absolutely necessary to discharge the transparent ink onto the entire surface of the color image. Accordingly, it is possible to appropriately modify the duty which is discharged from the transparent ink.

Applied Example

Next, an applied example of the invention has been illustrated but the invention is not limited to the applied example described below, it is of course possible to apply by adding appropriate modifications in the scope which appropriately applies the gist of the above and below descriptions and the modifications are included in the technical scope of the invention.

In this applied example, numerical examples which satisfy the expression 9 described above are illustrated in a case where the diameter of the platen drum 30 is 400 mm, and the transportation speed of the sheet M is 350 mm/s. Specifically, as in the embodiment described above, the time tm where the sheet M passes by from the position P62 where the UV lamp 62 irradiates ultraviolet rays to the position P52 where the recording head 52 discharges ink is:

$$tm=(400\times3.14\times28/360)/250=0.39\ \text{s}$$

in a case where the interval between the UV lamp 62 and the recording head 52 is 28 degrees. Therefore, a numerical example, where the time t in expression 9 described above is equal to or less than tm, will be illustrated below.

FIG. 5 is a diagram illustrating a numerical example of cases where the color images are formed by discharging acrylic ink onto a sheet of paper as a table. FIG. 6 is a diagram where changes over time of the proportion of heat which is transferred from the color image to the platen drum are found from the numerical example of FIG. 5 and illustrated as a graph. In FIG. 6, transfer time of the color image after passing by the ultraviolet irradiation position P62 of the UV lamp 62 is taken as the horizontal axis, and the proportion k of the heat amount which is transferred from the color image to the platen drum 30 is taken as the vertical axis. In the numerical examples shown in FIG. 5 and FIG. 6, the time t, where the quantity of heat which is transferred is 99%, is 0.27 s and is shorter than tm (0.39 s). Accordingly, it is possible to sufficiently (equal to or more than 99%) cool before the ink, which receives the irradiation of the ultraviolet rays from the UV lamp 62, passes by the recording head 52.

Figures 7, 8:
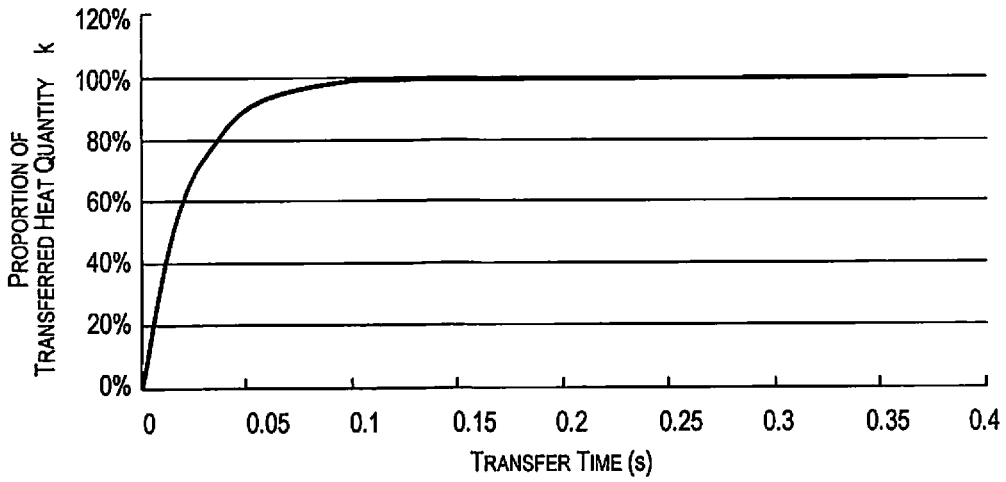
FIG. 7 is a diagram illustrating a numerical example of a case where the image is formed by acrylic ink on polypropylene.
FIG. 8 is a diagram illustrating changes over time of the proportion of heat which is transferred from the image to the platen drum.

FIG. 7 is a diagram illustrating numerical examples of cases where the color images are formed by discharging acrylic ink onto a polypropylene sheet as a table. FIG. 8 is a diagram where changes over time of the proportion of heat which is transferred from the color image to the platen drum are found from a numerical example of FIG. 7 and illustrated as a graph. In FIG. 8, transfer time of the color image after passing by the ultraviolet irradiation position P62 of the UV lamp 62 is taken as the horizontal axis, and the proportion k of the heat amount which is transferred from the color image to the platen drum 30 is taken in the vertical axis. In the numerical examples shown in FIG. 7 and FIG. 8, the time t, where the quantity of heat which is transferred is 99%, is 0.096 s and is shorter than tm (0.39 s). Accordingly, it is possible to sufficiently (equal to or more than 99%) cool the ink before the ink, which receives the irradiation of the ultraviolet rays from the UV lamp 62, passes by the recording head 52.

What is claimed is:

1. An image recording device comprising:

a rotation drum which supports a recording medium by coming into contact with one surface of the recording medium;

a first head, a second head, and a third head which are lined up in a transport direction of the recording medium at a position opposing the rotation drum, the first head and the second head being configured to discharge photo curable inks onto the other surface of the recording medium which is transported in the transport direction while being supported by the rotation drum, and the third head being configured and arranged to discharge transparent ink;

a first light source which is disposed between the first head and the second head to oppose the rotation drum in the transport direction, and configured and arranged to irradiate light onto the photo curable inks; and a second light source which is disposed more to the downstream side in the transport direction than the second head, which is disposed more to the downstream side in the transport direction than the first head, the second light source being configured and arranged to irradiate light onto the photo curable inks landed on the recording medium before the transparent ink is discharged from the third head onto the photo curable inks landed on the recording medium, the second light source being configured and arranged to irradiate light which is stronger than the light irradiated by the first light source, the second light source being disposed adjacent to the second head and the third head, which is disposed more on the downstream side in the transport direction than the second light source, wherein an angle formed between the first light source and the second head around a central shaft of the rotation drum is smaller than an angle formed between the second head and the second light source around the central shaft of the rotation drum.

2. The image recording device according to claim 1, wherein the second head is configured and arranged to discharge color ink.

3. The image recording device according to claim 1, wherein a time t, during which the recording medium moves from a position where the second light source irradiates light to a position where the third head discharges the transparent ink, satisfies a relational expression of $$t > -(Ci \cdot \rho i \cdot Li \cdot Lm / \lambda m) \log_e(1/100)$$

where λm is a heat conductivity of the recording medium, Lm is a thickness of the recording medium, Li is a thickness of the color ink landed on the recording medium, Ci is a density of the color ink landed on the recording medium, and pi is a specific heat of the color ink.

4. The image recording device according to claim 1, wherein the angle formed between the second head and the second light source around the central shaft of the rotation drum is smaller than an angle formed between the second light source and the third head around the central shaft of the rotation drum.

5. An image recording device comprising:

a rotation drum which supports a recording medium by coming into contact with one surface of the recording medium;

a first head, a second head, and a third head which are lined up in a transport direction of the recording medium at a position opposing the rotation drum, the first head and the second head being configured to discharge photo curable inks onto the other surface of the recording medium which is transported in the transport direction while being supported by the rotation drum, and the third head being configured and arranged to discharge transparent ink;

a first light source which is disposed between the first head and the second head to oppose the rotation drum in the transport direction, and configured and arranged to irradiate light onto the photo curable inks so that the photo curable inks are pre-cured by the light irradiated by the first light source; and a second light source which is disposed more to the downstream side in the transport direction than the second head, which is disposed more to the downstream side in the transport direction than the first head, the second light source being configured and arranged to irradiate light onto the photo curable inks landed on the recording medium before the transparent ink is discharged from the third head onto the photo curable inks landed on the recording medium so that the photo curable inks are completely cured by the light irradiated by the second light source, the second light source being disposed adjacent to the second head and the third head, which is disposed more on the downstream side in the transport direction than the second light source, wherein an angle formed between the first light source and the second head around a central shaft of the rotation drum is smaller than an angle formed between the second head and the second light source around the central shaft of the rotation drum.

* * * * *